US007976238B2

(12) United States Patent
Hall et al.

(10) Patent No.: US 7,976,238 B2
(45) Date of Patent: Jul. 12, 2011

(54) END OF A MOLDBOARD POSITIONED PROXIMATE A MILLING DRUM

(76) Inventors: David R. Hall, Provo, UT (US); Jeff Jepson, Spanish Fork, UT (US); Thomas Morris, Spanish Fork, UT (US); Joseph Nielson, Provo, UT (US); Ronald B. Crockett, Payson, UT (US); Gary Peterson, Salem, UT (US); David Wahlquist, Spanish Fork, UT (US)

( * ) Notice: Subject to any disclaimer, the term of this patent is extended or adjusted under 35 U.S.C. 154(b) by 0 days.

(21) Appl. No.: 12/888,876

(22) Filed: Sep. 23, 2010

(65) Prior Publication Data

US 2011/0013983 A1 Jan. 20, 2011

Related U.S. Application Data

(63) Continuation-in-part of application No. 12/145,409, filed on Jun. 24, 2008, now Pat. No. 7,854,566, which is a continuation-in-part of application No. 11/566,151, filed on Dec. 1, 2006, now Pat. No. 7,458,645, and a continuation-in-part of application No. 11/668,390, filed on Jan. 29, 2007, now Pat. No. 7,507,053, and a continuation-in-part of application No. 11/644,466, filed on Dec. 21, 2006, now Pat. No. 7,596,975.

(51) Int. Cl.
*E01C 23/08* (2006.01)

(52) U.S. Cl. ..... 404/83; 404/94

(58) Field of Classification Search ..... 404/90–94, 404/122–129; 299/36–39
See application file for complete search history.

(56) References Cited

U.S. PATENT DOCUMENTS 1,898,158 A * 2/1933 Winkle
2,039,078 A * 4/1936 Hertwig
1,887,341 A * 11/1936 Venable
2,098,895 A * 11/1937 Velten
2,124,438 A * 7/1938 Struk
2,633,782 A * 4/1953 Clement
2,893,299 A * 7/1959 Moir
2,908,206 A * 10/1959 Melanson
2,938,438 A * 5/1960 Hamilton
3,075,436 A * 1/1963 McRae
3,254,392 A * 6/1966 Novkov
3,361,042 A * 1/1968 Cutler
3,732,023 A * 5/1973 Rank
3,746,396 A * 7/1973 Radd
3,817,644 A * 6/1974 Matson
3,830,321 A * 8/1974 McKenry
3,970,404 A * 7/1976 Benedetti
3,989,401 A * 11/1976 Moench
4,018,540 A 4/1977 Jackson
4,041,623 A * 8/1977 Miller et al. ..... 37/382
4,098,362 A 7/1978 Bonnice
4,104,736 A 8/1978 Mendenhall
4,109,737 A 8/1978 Bovenkerk
(Continued)

*Primary Examiner* — Raymond W Addie
(74) *Attorney, Agent, or Firm* — Tyson J. Wilde; Philip W. Townsend, III

(57) ABSTRACT

In one aspect of the present invention, the present invention is a system for removing aggregate from a paved surface. The system includes a motorized vehicle with a degradation drum that is connected to the underside of the vehicle. The degradation drum is enclosed by a milling chamber. The milling chamber is defined by having a plurality of plates, including a moldboard positioned rearward of the milling drum. The moldboard comprises an end that is disposed opposite the underside. The end comprises a section that is proximate the milling drum.

20 Claims, 8 Drawing Sheets

U.S. PATENT DOCUMENTS 4,124,325 A 11/1978 Cutler
4,127,351 A 11/1978 Vural
4,139,318 A 2/1979 Jakob
4,156,329 A 5/1979 Daniels
4,172,616 A 10/1979 Delli-Gatti, Jr.
4,172,679 A 10/1979 Wirtgen
4,175,886 A 11/1979 Moench
4,195,946 A 4/1980 Swisher
4,199,035 A 4/1980 Thompson
4,201,421 A 5/1980 Den Besten
4,215,949 A 8/1980 Gabriel
4,261,669 A 4/1981 Edo
4,268,089 A 5/1981 Spence
4,313,690 A 2/1982 Hojbjerg
4,335,975 A 6/1982 Schoelkopf
4,346,525 A 8/1982 Larsen
4,407,605 A 10/1983 Wirtgen
4,439,250 A 3/1984 Acharya
4,473,320 A 9/1984 Register
4,484,783 A 11/1984 Emmerich
4,534,674 A 8/1985 Cutler
4,594,022 A 6/1986 Jeppson
4,637,753 A * 1/1987 Swisher, Jr. ..... 404/90
4,668,017 A 5/1987 Petersen
4,676,689 A 6/1987 Yant
4,684,176 A 8/1987 Den Besten
4,692,350 A 9/1987 Clarke
4,704,045 A * 11/1987 Taylor et al. ..... 404/90
4,725,098 A 2/1988 Beach
4,728,153 A 3/1988 Ojanen
4,755,001 A * 7/1988 Gilbert ..... 299/39.8
4,776,862 A 10/1988 Wiand
4,784,518 A 11/1988 Cutler
4,793,730 A 12/1988 Butch
4,827,559 A 5/1989 Norland
4,836,614 A 6/1989 Ojanen
4,850,649 A 7/1989 Beach
4,878,713 A * 11/1989 Zanetis ..... 299/39.5
4,880,154 A 11/1989 Tank
4,921,310 A 5/1990 Hedlund
4,932,723 A 6/1990 Mills
4,940,288 A 7/1990 Stiffler
4,944,559 A 7/1990 Sionnet
4,951,762 A 8/1990 Lundell
4,968,101 A 11/1990 Bossow
5,007,685 A 4/1991 Beach
5,026,205 A 6/1991 Gorski
5,074,063 A 12/1991 Vannette
5,078,540 A 1/1992 Jakob
5,112,165 A 5/1992 Hedlund
5,131,788 A 7/1992 Hulicsko
5,141,289 A 8/1992 Stiffler
5,186,892 A 2/1993 Pope
5,219,380 A 6/1993 Young
5,251,964 A 10/1993 Ojanen
5,303,984 A 4/1994 Ojanen
5,366,320 A 11/1994 Hanlon
5,382,084 A 1/1995 Diver
5,392,540 A 2/1995 Cooper
5,415,462 A 5/1995 Massa
RE35,088 E * 11/1995 Gilbert
5,490,339 A 2/1996 Accettola
5,503,463 A 4/1996 Ojanen
5,505,598 A 4/1996 Murray
5,556,225 A 9/1996 Marino
5,720,528 A 2/1998 Ritchey
5,725,283 A 3/1998 O'Neill
5,730,502 A 3/1998 Montgemery
5,738,698 A 4/1998 Kapoor
5,765,926 A 6/1998 Knapp
5,791,814 A 8/1998 Wiley
5,794,854 A 8/1998 Yie
5,823,632 A 10/1998 Burkett
5,837,071 A 11/1998 Andersson
5,884,979 A 3/1999 Latham
5,934,542 A 8/1999 Nakamura
5,935,718 A 8/1999 Demo
5,944,129 A 8/1999 Jensen
5,947,636 A 9/1999 Mara
5,947,638 A 9/1999 Heims
5,951,561 A 9/1999 Pepper
6,051,079 A 4/2000 Andersson
6,065,552 A 5/2000 Scott
6,113,195 A 9/2000 Mercier
6,122,601 A 9/2000 Swanson
6,158,920 A 12/2000 Malot
6,193,770 B1 2/2001 Sung
6,196,636 B1 3/2001 Mills
6,199,956 B1 3/2001 Kammerer
6,287,048 B1 9/2001 Hollon
6,341,823 B1 1/2002 Sollami
6,357,832 B1 3/2002 Sollami
6,371,689 B1 4/2002 Wiley
6,457,267 B1 10/2002 Porter
6,478,383 B1 11/2002 Ojanen
6,481,803 B2 11/2002 Ritchey
6,508,516 B1 1/2003 Kammerer
6,543,963 B2 4/2003 Bruso
6,551,018 B2 4/2003 Baker
6,577,141 B2 6/2003 Gandrud
6,623,207 B2 9/2003 Grubba
6,644,755 B1 11/2003 Kammerer
6,692,083 B2 2/2004 Latham
6,702,393 B2 3/2004 Mercier
6,733,086 B1 5/2004 McSharry
6,769,836 B2 8/2004 Lloyd
6,779,948 B2 8/2004 Bruso
6,786,557 B2 9/2004 Montgomery, Jr.
6,799,922 B2 10/2004 Smith
6,824,225 B2 11/2004 Stiffler
6,846,354 B2 1/2005 Larsen
6,851,758 B2 2/2005 Beach
6,854,201 B1 2/2005 Hunter
6,854,810 B2 2/2005 Montgomery, Jr.
6,861,137 B2 3/2005 Griffin et al.
6,889,890 B2 5/2005 Yamazaki
6,962,395 B2 11/2005 Mouthaan
7,150,131 B2 12/2006 Barker
7,179,018 B2 2/2007 Hall
7,223,049 B2 5/2007 Hall
7,287,818 B1 10/2007 Hall
7,387,345 B2 6/2008 Hall
7,387,464 B2 6/2008 Hall
7,387,465 B2 6/2008 Hall
7,396,085 B2 7/2008 Hall
7,413,375 B2 8/2008 Hall
7,473,052 B2 1/2009 Hall
7,544,011 B2 6/2009 Hall
7,549,821 B2 6/2009 Hall
7,585,128 B2 9/2009 Hall
7,591,607 B2 9/2009 Hall
7,591,608 B2 9/2009 Hall
7,641,418 B2 1/2010 Hall
7,712,996 B2 5/2010 Hall
2002/0070602 A1 6/2002 Sollami
2002/0074851 A1 6/2002 Montgomery
2002/0153175 A1 10/2002 Ojanen
2002/0175555 A1 11/2002 Mercier
2003/0137185 A1 7/2003 Sollami
2003/0141350 A1 7/2003 Noro
2003/0141753 A1 7/2003 Peay
2003/0230926 A1 12/2003 Mondy
2003/0234280 A1 12/2003 Cadden
2004/0026983 A1 2/2004 McAlvain
2005/0159840 A1 7/2005 Lin
2005/0173966 A1 8/2005 Mouthaan
2006/0125306 A1 6/2006 Sollami
2008/0284235 A1 11/2008 Hall

* cited by examiner

END OF A MOLDBOARD POSITIONED PROXIMATE A MILLING DRUM

CROSS REFERENCE TO RELATED APPLICATIONS

This application is a continuation-in-part of U.S. patent application Ser. No. 12/145,409 filed on Jun. 24, 2008 now U.S. Pat. No. 7,854,566, which was a continuation-in-part of U.S. patent application Ser. Nos. 11/566,151 filed on Dec. 01, 2006 now U.S. Pat. No. 7,458,645; Ser. No. 11/668,390 filed on Jan. 29, 2007 now U.S. Pat. No. 7,507,053; and Ser. No. 11/644,466 filed on Dec. 21, 2006 now U.S. Pat. No. 7,596,975. All of these documents are herein incorporated by reference for all that they disclose.

BACKGROUND OF THE INVENTION

The present invention relates to machines that are used in road construction, such as a milling machine. These machines may remove a layer or layers of old or defective road surfaces to prepare for resurfacing. Typically, milling machines are equipped with a milling drum secured to the machine's underside. The drums are configured to direct milling debris toward a conveyer, which directs the debris to a dump truck to take off site.

A moldboard may be located behind the milling drum during operation and form part of a milling chamber that encloses the drum. The moldboard is configured to push milling debris forward with the machine. However, some debris usually escapes underneath the bottom end of the moldboard leaving the recently milled surface too dirty to resurface. Failure to clean the milled surface before resurfacing may result in poor bonding between the new layer and the milled surface. Typically, a sweeper will follow the milling machine to remove the debris, but the sweeper is generally inefficient.

BRIEF SUMMARY OF THE INVENTION

In one aspect of the present invention, the present invention is a system for removing aggregate from a paved surface. The system includes a motorized vehicle with a degradation drum that is connected to the underside of the vehicle. The degradation drum is enclosed by a milling chamber. The milling chamber is defined by having a plurality of plates, including a moldboard positioned rearward of the milling drum. The moldboard comprises an end that is disposed opposite the underside. The end comprises a section that is proximate the milling drum.

The moldboard's end, by virtue of its proximity to the degradation drum, may restrict any loose aggregate from leaving the drum's proximity. Thus, the drum remains capable of directing the aggregate towards a conveyor for removal from the milling chamber. The moldboard may also direct aggregate towards the milling drum resulting in less aggregate accumulation and cleaner milled surfaces.

The moldboard may comprise a series of fluid nozzles. The nozzles may be located under the moldboard's end and may push the aggregate with a liquid toward the degradation drum and suppress dust generated from milling. The liquid may also be used to reduce friction, absorb heat, and clean the drum. Another series of nozzles located inside the milling chamber may clean the moldboard off and direct any aggregate back to the drum.

A blower mechanism may also be connected rearward of the moldboard and direct a gas, such as air, $CO_2$, exhaust, or ambient air underneath the moldboard. The gas may dry off the roadway from the liquid jets as well as contribute to directing aggregate towards the milling drum.

In another aspect of the invention, the invention is a system for removing aggregate from a paved surface. In one aspect of the invention a motorized vehicle has a degradation drum that is connected to the underside of the vehicle. The milling drum is enclosed by a milling chamber. The milling chamber is defined by having a plurality of plates, including a moldboard configured to reside rearward of the degradation drum. The moldboard is configured to rotate about the degradation drum.

DETAILED DESCRIPTION OF THE INVENTION AND THE PREFERRED EMBODIMENT

Figure 1:
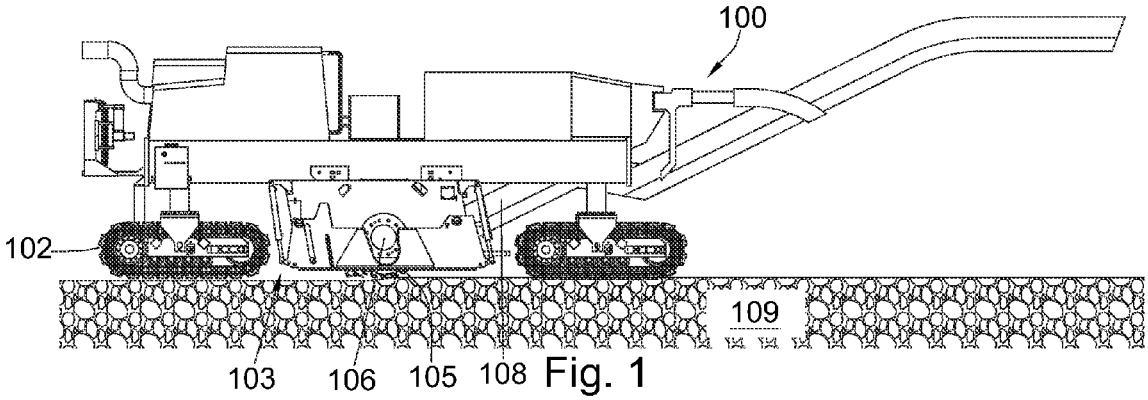
FIG. 1 is an orthogonal diagram of an embodiment of a motorized vehicle.

FIG. 1 discloses a milling machine 100 that may be used to remove asphalt from a paved surface 109. The current embodiment discloses the machine on tracks 102, but in other embodiments tires or other propulsion mechanisms may be used. A milling chamber 103 may be attached to the underside of the vehicle 100 and contain a milling drum 105, axle 106, and an opening for one end of a conveyor belt 108. The conveyor belt 108 may be adapted to remove debris from the milling chamber. The conveyor 108 may deposit the degraded surface into a truck (not shown). The truck may remove the degraded surface from the milling area.

Figure 2:
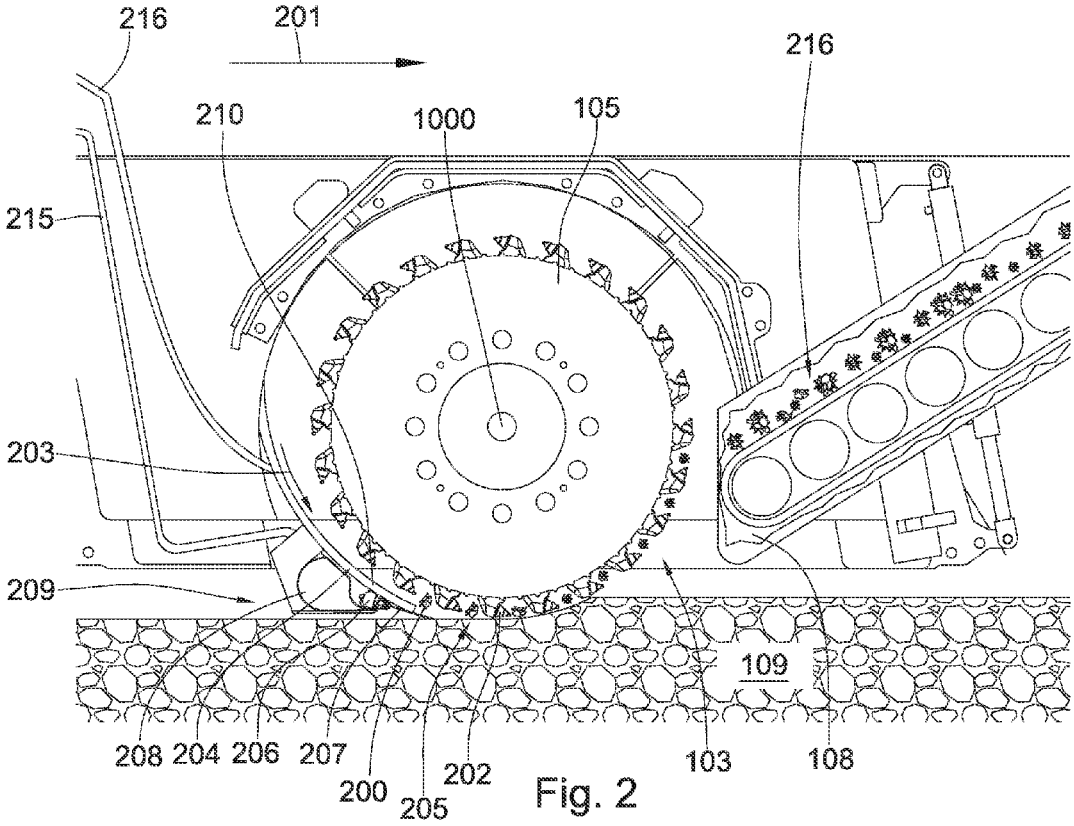
FIG. 2 is a cutaway diagram of an embodiment of a milling chamber.

FIG. 2 discloses the milling chamber 103 and the conveyor belt 108. In this embodiment the milling machine travels to the right, as disclosed by arrow 201, and the drum 105 rotates counter-clockwise. An internal combustion engine (not shown) may be used to drive the milling drum. The picks 202 degrade the paved surface by rotating into the paved surface as the milling vehicle 100 travels in the specified direction.

The picks 202 may comprise tungsten carbide or synthetic diamond tips. The picks 202 may lift the broken aggregate 200 up, some of which falls onto the conveyor belt 108. But, some of the aggregate is carried over the drum 105 by the picks 202 to the opposite side 203 of the milling chamber 103. Some of the aggregate may fall off the drum and land on a curved moldboard 204 or into the cut formed by the drum.

The moldboard 204 is located rearward of the milling drum. In some cases the moldboard 204 may push any loose aggregate 200 forward into the milling area 205 where it may be picked up by the milling drum 105 and directed to the conveyor belt 108. Sometimes the aggregate that falls down onto the moldboard 204 from the drum 105 may roll off into the milling area 205. In some cases the moldboard 204 may hold the aggregate closer to the picks 202, which clears the aggregate off towards the conveyor 108.

A plurality of nozzles 206 lies rearward of the moldboard and may force the aggregate forward. This prevents aggregate from escaping the milling chamber under the moldboard as the milling machine moves forward. As the fluid stream 207 from the plurality of nozzles 206 is ejected into the milling chamber, the loose aggregate is forced forward into the milling area 205. In some embodiments, the nozzles fog, mist, spray, steam, and/or shoot fluid underneath an end of the moldboard. Some embodiments include the fluid nozzles attached to the backside of the moldboard and/or the moldboard's front side. A blower mechanism 208 may lie rearward of the plurality of nozzles 206 and may blow on the cut surface 209 after the nozzles 206 have cleaned the surface 209. The blower mechanism 208 may blow loose aggregate in front of the moldboard that the fluid nozzles 206 miss and the blower mechanism 208 may also dry off the milled surface.

The moldboard 204 is located rearward of the milling drum 105. One purpose of the moldboard 204 is to contain loose aggregate 200 that the milling drum 105 degrades, but does not deposit onto the conveyor belt 108. This embodiment discloses a moldboard 204 that is curved toward the milling drum 105 with the end 210 located within one foot of the milling drum 105. Because of the proximity of the moldboard 204, the picks may catch loose aggregate that collects on the moldboard. This aggregate may roll off into the milling zone 205 where the picks 202 may lift the aggregate up and deposit it onto the conveyor 108, or the deposited aggregate may be manually removed by the picks.

In some embodiments the moldboard 204 may be less than 0.25 inches above the bottom of the depth of the cut 209. Placing the moldboard 204 close to the bottom of the depth of the cut 209 may allow the moldboard 204 to push the aggregate 200 forward. The milling drum 105 may then reengage the loose aggregate and deposit it onto the conveyor 108 where the loose aggregate 206 may be removed from the milling chamber 103. The fluid nozzles 206 may spray the cut surface 209 to help contain the loose aggregate 200 ahead of the moldboard. The blower mechanism 208 dries off the surface 209 where the fluid nozzles 206 spray. In other embodiments the moldboard 204 may generally follow the contour of the milling drum 105. The moldboard 204 may contain the loose aggregate 200, leaving the milled surface substantially free of millings, debris, loose aggregate, dirt, rocks, asphalt, etc.

The fluid nozzles 206 may be in communication with a fluid pathway 216. The fluid nozzles 206 may use less energy in embodiments where the moldboard is curved and directs the aggregate to the milling zone. Spraying less fluid 207 may conserve resources and be more efficient. The blower mechanism 208 placed rearward the fluid nozzles 206 may also use less energy to dry the cut surface 209 because the fluid nozzles 206 may spray less fluid 207. The angle between the end of the moldboard 210 and the ground 209 may be similar to the angle between the nozzles' spray 207 and the ground 209. This may lead to the fluid 207 having a synergistic effect with the moldboard 204 in forcing the aggregate 200 forward. The fluid 207 also may reduce dust that may interfere with bonding a new surface. The fluid ejected 207 from the nozzles may also assist in reducing friction between the moldboard 204 and cut and between the picks and the paved surface.

A blower mechanism 208 is located rearward of the plurality of nozzles 206. The gas blown by the blower mechanism 208 may include exhaust, compressed air, atmospheric air and/or combinations thereof. The blower mechanism may be in communication with a gas pathway 215 that may be directed to blow the cut surface 209 where the fluid 207 has been sprayed. The blower mechanism 208 may blow the fluid 207 forward and dry out the cut surface 209. This may allow the resurfacing to begin directly after the process of degrading the paved surface. The blower mechanism 208 may also be set to assist in pushing loose aggregate 200 and debris toward the milling drum 105.

Figure 3A:
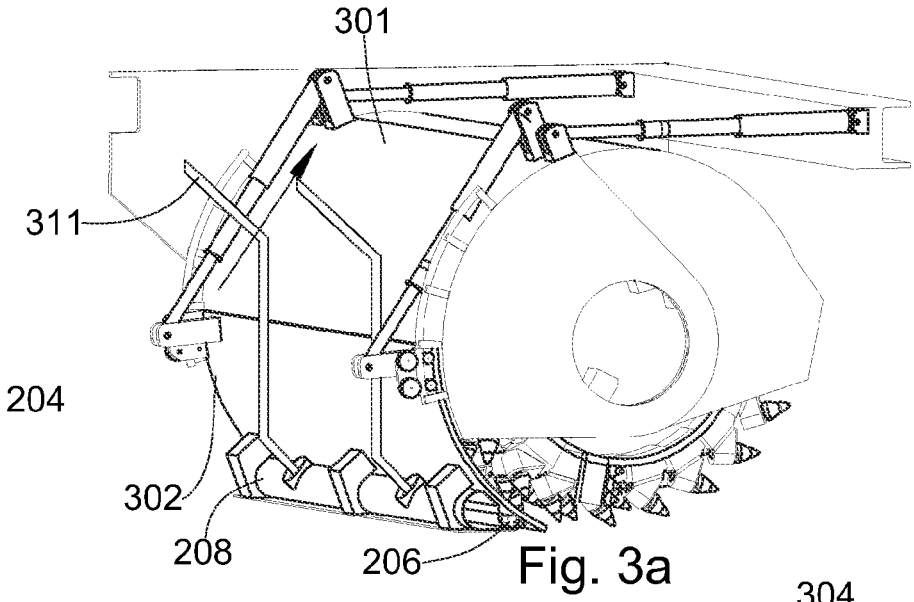
FIG. 3*a* is a perspective diagram of another embodiment of a moldboard.

FIG. 3*a* discloses a perspective view of the moldboard 204 comprising two parts, an upper portion 301 and a lower extension 302. The moldboard 204 follows the contour of the milling drum 105. Both parts of the moldboard 204 may be retracted. Retracting the lower extension 302 may also retract the gas pathways 311, the blower mechanism 208, the fluid pathways, and the nozzles 206.

Figure 3B:
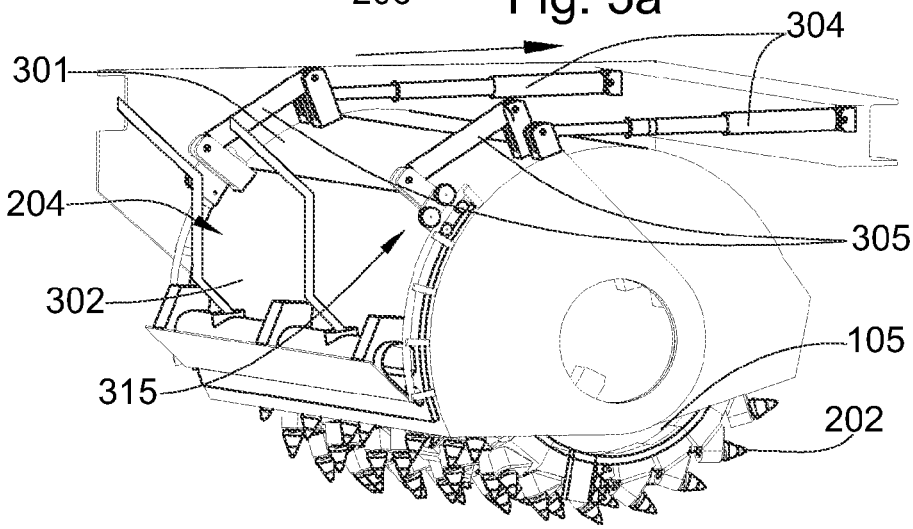
FIG. 3*b* is a perspective diagram of another embodiment of a moldboard.

FIG. 3*b* discloses that the lower extension may rotate upward. Hydraulic arms 304, 305 are in two pairs with each pair 304, 305 having two arms. The lower set of hydraulic arms 305 may pull the lower extension 302 at an angle, such that the lower extension rotates upward. A curved rack and pinion assembly 315 may help guide the extension. Hydraulic arms 304, 305 may retract the upper portion 301 and the lower extension 302 following the contour of the milling drum 105. In other embodiments, the pinions may be actively driven by a motor or other driver to rotate the extension.

Figure 3C:
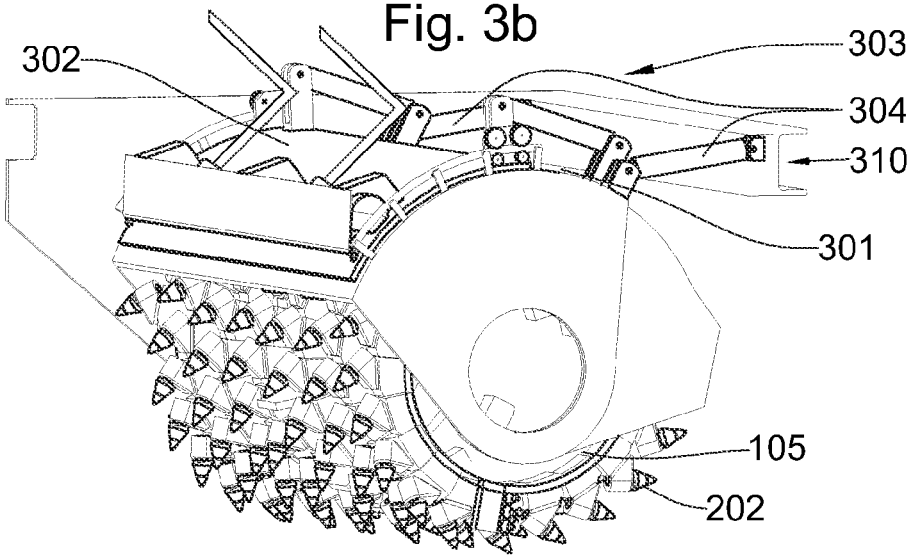
FIG. 3*c* is a perspective diagram of another embodiment of a moldboard.

FIG. 3*c* discloses the upper portion 301 and lower extension 302 rotated to reveal a majority of the picks 202. The second set of hydraulic arms may connect the upper portion 301 204 and the vehicle frame 310. These arms 304 may retract, thereby, pulling the lower extension 302 nearly directly above the milling drum 105. Raising the lower extension may assist in cleaning and repairing the picks.

Both the lower extension and the upper portion may be configured to rotate about the axis or axel 1000 of the drum. In some embodiments, the moldboard is made of a single piece and rotates as a unitary mass around the axel of the drum. The design of the milling chamber and the machine may be simplified by rotating a moldboard or moldboard sections about the drum.

Figure 4:
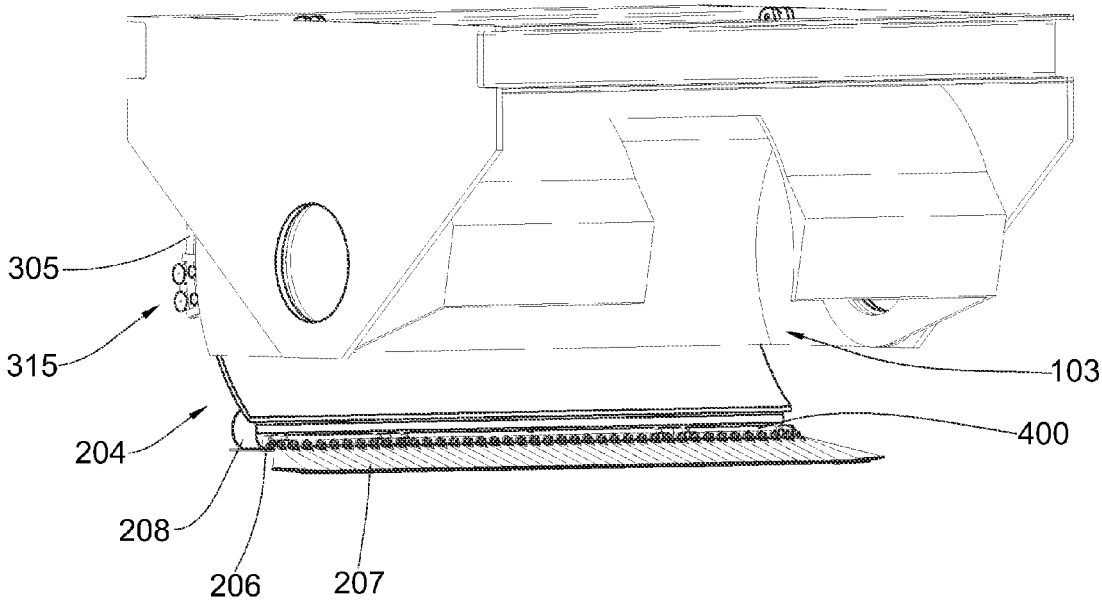
FIG. 4 is a perspective diagram of an embodiment of a moldboard.

FIG. 4 is a diagram of a perspective view of the milling chamber 103, including the moldboard 204, the plurality of nozzles 206, and the blower mechanism 208. In this embodiment, the milling drum 105 has been removed and the moldboard 204 has been drawn up slightly to disclose the fluid nozzles 206. Also, the fluid 207 exiting out of the fluid nozzles 206 is disclosed in this embodiment. The fluid 207 may travel from the fluid reservoir (not shown), down the fluid pathway, and into a fluid manifold 400. The fluid manifold 400 may attach to the fluid nozzles 206 and distribute the fluid 207 at an equalized pressure to the fluid nozzles 206.

The fluid nozzles may extend a length of the moldboard and spray underneath the entirety of the moldboard. The nozzles may eject a liquid in a direct path from the end of the nozzles toward the milling drum and may force the liquid under the base of the moldboard and contain the loose aggregate ahead of the moldboard. Liquid and energy may be minimized as the liquid may push the aggregate in the shortest path from the end of the moldboard to the milling area where the picks may pick up the aggregate and place it on the conveyor belt. In another embodiment the liquid nozzles may dispense liquid in a crosswise pattern that may more effectively clear the cut surface of debris.

Figure 5:
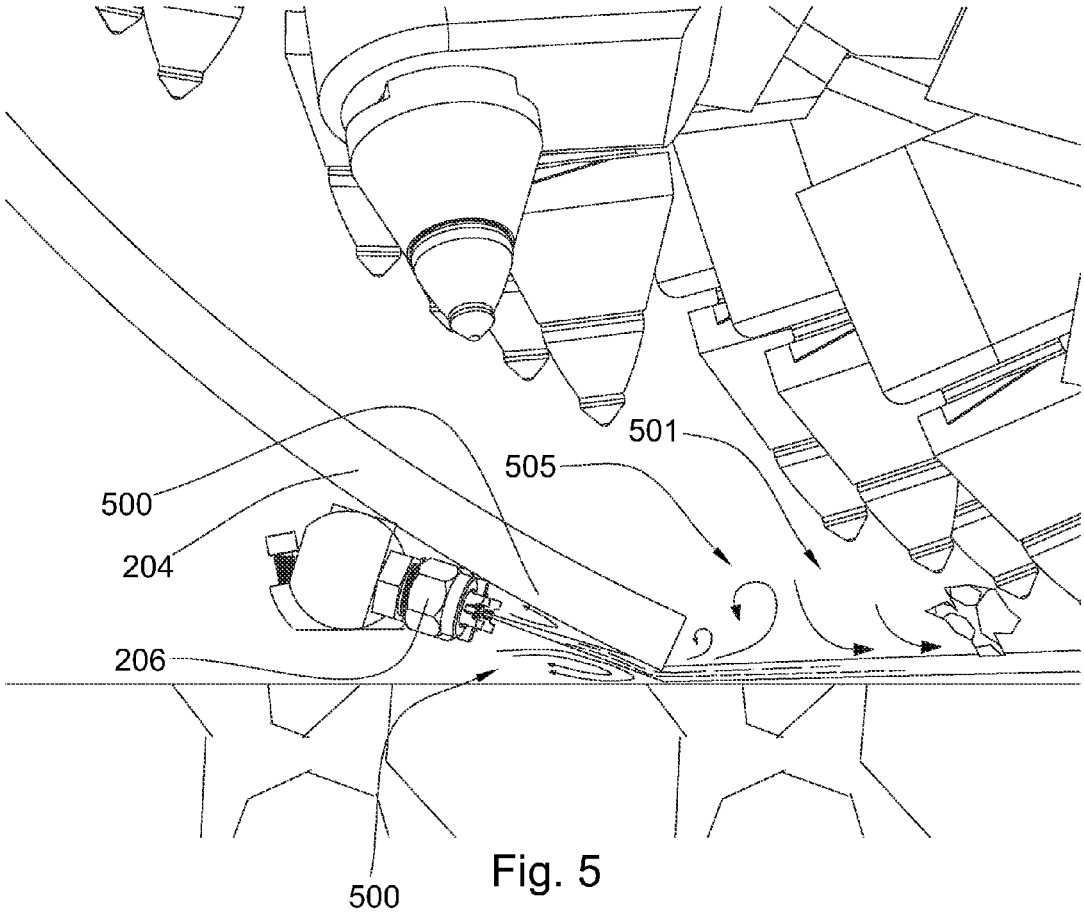
FIG. 5 is a perspective diagram of an embodiment of fluid nozzles.

FIG. 5 is an orthogonal diagram of the plurality of fluid nozzles 206 that may be disposed proximate the end of the moldboard 204. This diagram depicts the air flow caused by the fluid nozzles 206. The fast flowing liquid 207 may travel at a high velocity and draw in the nearby ambient air around and into the liquid stream 207. The air to the rear 500 of the moldboard 204 may be drawn toward the liquid stream 207 that may have a high velocity and low pressure. Some of that air may enter into the liquid pathway 207 and become part of the fast flowing liquid-air mix 207. Other currents of air 500 may be drawn toward the stream 207 but not enter it. This air 500 may eventually circulate around the surrounding surfaces, such as the moldboard 204 or cut surface 109, and promote the residual fluid's evaporation leaving the cut surface dry.

After the liquid-air mix 207 escapes from under the moldboard 204 some of the enclosed air 502 may eddy. This may be due to the cross section that the air 502 may enter after passing under the bottom of the moldboard 204. As the cross section increases the pressure decreases which may allow the trapped air 502 to escape. The escaping air 502 may exit the liquid flow 207, contact surrounding ambient air, and eddy. Further along the liquid stream 207 the surrounding air may be drawn toward the low pressure located in the fluid stream.

Figure 6:
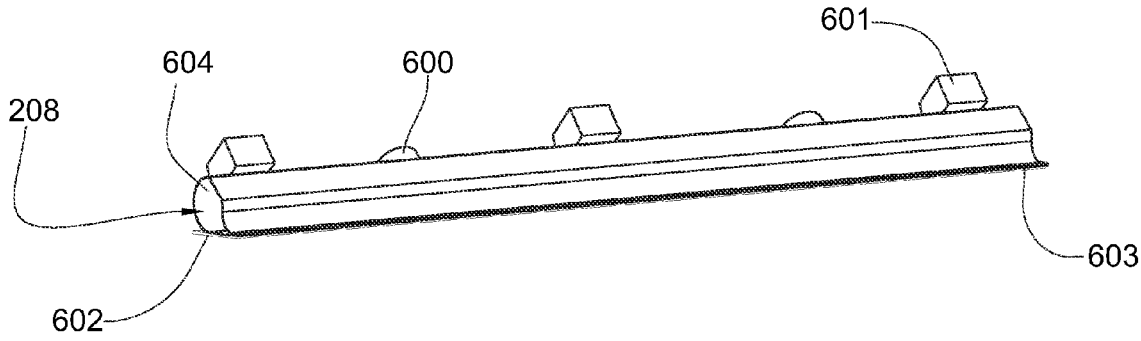
FIG. 6 is a perspective diagram of an embodiment of a blower mechanism.

FIG. 6 is a diagram of a perspective view of the blower mechanism 208. The blower mechanism 208 may be located rearward of the moldboard 204 and the plurality of nozzles 206. The blower mechanism 208 may be attached to a compressor (not shown) through a gas manifold 604. The gas manifold 604 may be attached to the gas pathway 215 through the conduits 600 that may be manufactured into the rear of the blower mechanism 208. The gas pathway 215 and/or fluid pathway 216 may comprise a flexible hose that is configured to accommodate the moldboard's movement.

The blower mechanism 208 may further comprise a wear resistant material 602 that may be located proximate the ground. The wear resistant material may have a hardness of at least 63 HRc. The material may support the gas manifold, the liquid jet nozzles, and the fluid manifold. The material may also protect the both the gas and fluid manifolds and the nozzles from excessive wear against the cut.

Figure 7:
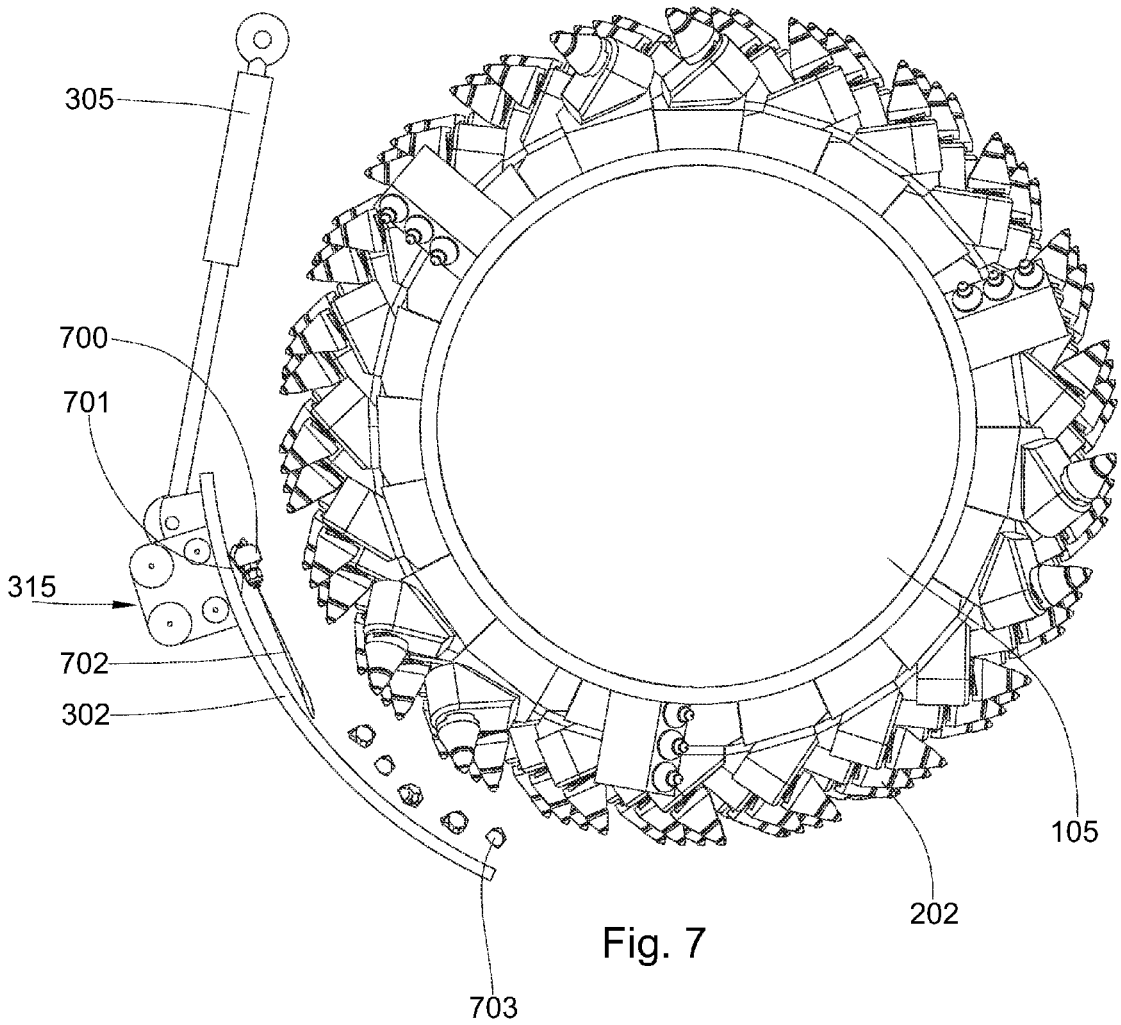
FIG. 7 is a perspective diagram of an embodiment of plurality of fluid nozzles.
Figure 8A:
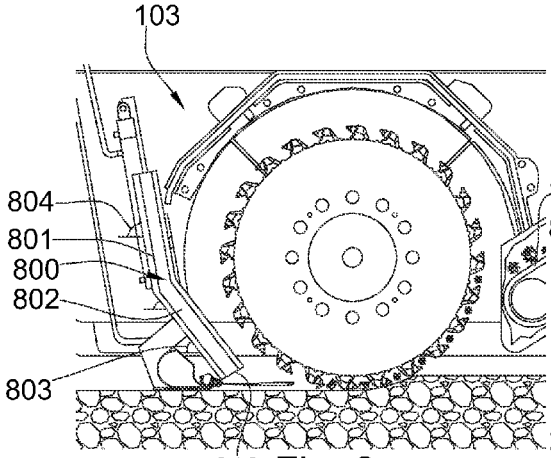
FIG. 8*a* is an orthogonal diagram of an alternative embodiment of a moldboard.
Figure 8B:
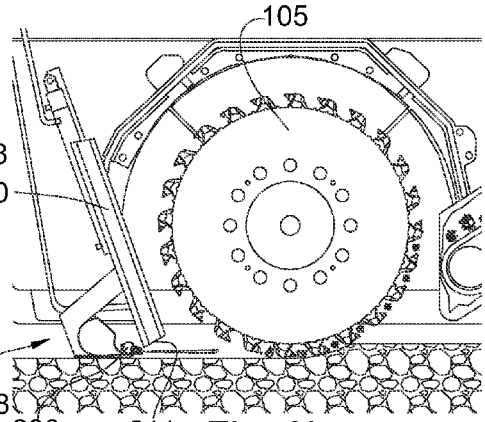
FIG. 8*b* is another orthogonal diagram of an alternative embodiment of a moldboard.
Figure 8C:
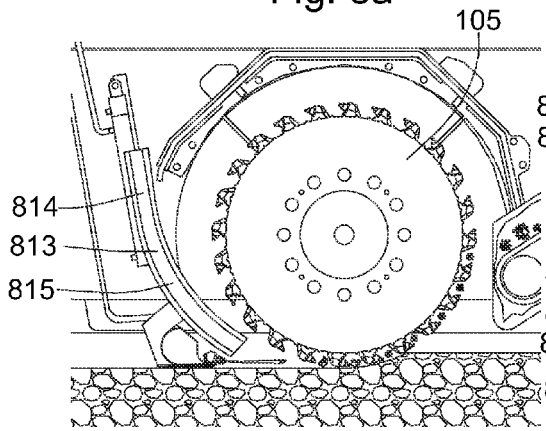
FIG. 8*c* is another orthogonal diagram of an alternative embodiment of a moldboard.
Figure 8D:
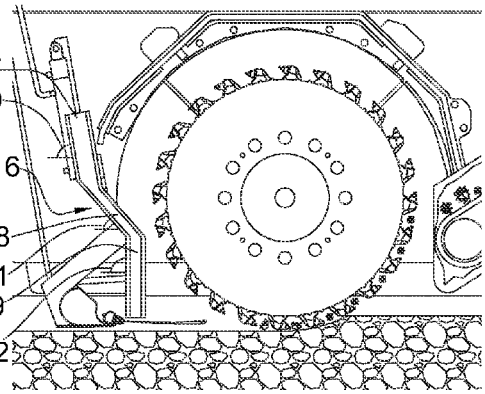
FIG. 8*d* is another orthogonal diagram of an alternative embodiment of a moldboard.
Figure 8E:
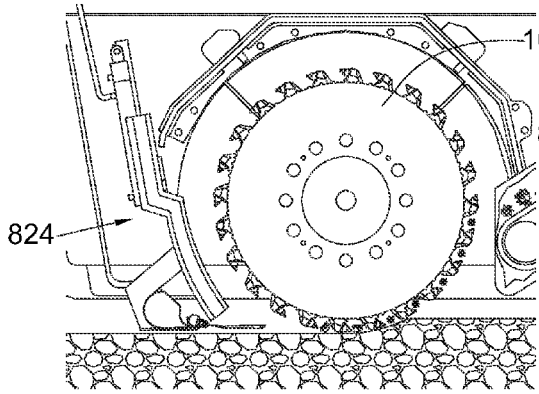
FIG. 8*e* is another orthogonal diagram of an alternative embodiment of a moldboard.
Figure 8F:
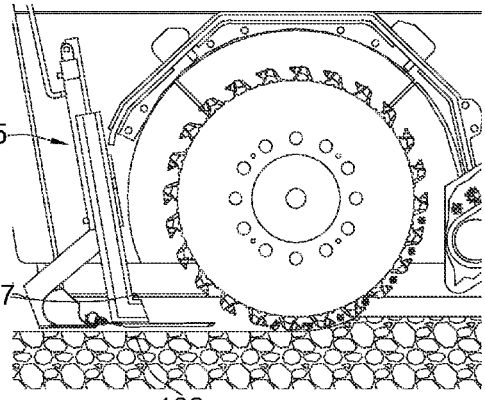
FIG. 8*f* is another orthogonal diagram of an alternative embodiment of a moldboard.

FIG. 7 is a diagram of a perspective view of a plurality of nozzles 700 that may be located on the moldboard 302, but inside of the milling chamber. The fluid nozzles 700 may be attached to a fluid manifold 701. A fluid 702 may exit the fluid reservoir (not shown), travel down the fluid pathway 216, enter the fluid manifold 701 to the fluid nozzles 700. The liquid may exit the fluid nozzles and clear off the moldboard 302 of any aggregate 703. A system for cleaning off the moldboard may comprise one or more nozzles. In some embodiments the plurality of nozzles 700 may be adapted to oscillate back and forth. This action may assist in cleaning off the moldboard.

Nozzles 700 located at the top section of the moldboard 302 may expel fluid 702 to clean off the particulate 703 that may land on the moldboard 302. The nozzles 700 may turn off and on to loosen particulate piles that build-up on the moldboard 302. This may prevent the moldboard 302 from getting too heavy. Reducing the weight that the moldboard 302 carries may reduce the energy needed to drive the milling machine 100. Also, this may lessen the cleaning time of the machine 100 and the moldboard 302 after the milling projects are completed.

FIG. 8 is an orthogonal view of the milling chamber 103 and conveyor belt 108 with alternative embodiments of the invention. FIG. 8*a* discloses a moldboard 800 that is comprised of two straight sections 801, 802 that are connected end to end and are angled toward the milling drum at different angles 803, 804. This may place the end of the moldboard 812 in close proximity to the milling drum 105. FIG. 8*b* discloses a moldboard 810 that is angled toward the milling drum 105 and an end of the moldboard 811, with the plurality of nozzles 206 and the blower mechanism 208, are proximate the base of the milling drum 105. This method may be better adapted to avoid particulate matter resting on the moldboard 810. FIG. 8*c* has a moldboard 813 that is comprised of two sections, a straight section that is straight 814 and a curved section 815 that is curved. And both sections approach the milling drum 105. FIG. 8*d* discloses a moldboard 816 that is composed of several straight sections 817, 818, 819 that are connected end to end and that approach the milling drum 105 through a series of angles 820, 821, 822 that allows the moldboard 816 to be in close proximity to the milling drum 105. FIG. 8*e* discloses a step down pattern for a moldboard where the moldboard 824 approaches the drum 105 by cutting in sharply toward the milling drum 105 and then following the contour of the drum 105. FIG. 8*f* has an L shaped moldboard 825 that approaches the ground 109 and then makes an 80-100 degree turn 827 toward the milling drum 105. This embodiment may need the fluid nozzles 206 to continually spray off the moldboard 825 to keep it free of a buildup of excessive aggregate.

What is claimed is:

1. A system for removing aggregate from a paved surface, comprising:

a vehicle comprising a degradation drum connected to an underside of the vehicle;

the degradation drum is enclosed by a milling chamber;

the milling chamber being defined by a plurality of plates including a moldboard positioned rearward of the degradation drum;

the milling chamber further comprising an opening configured to receive an end of a conveyor;

picks secured to the degradation drum are configured to lift broken aggregate from a paved surface and allow the broken aggregate to fall onto the conveyor;

the conveyor is configured to remove the aggregate from the milling chamber;

the moldboard comprising an end disposed opposite the underside of the milling machine, and the end is configured provide a space underneath the moldboard and above the depth of cut;

the end comprising a section that is proximate the degradation drum.

2. The system of claim 1, wherein the section is curved into the milling chamber.

3. The system of claim 1, wherein the section generally follows a contour of the degradation drum.

4. The system of claim 1, wherein the section is sharply sloped toward the degradation drum.

5. The system of claim 1, wherein the moldboard comprises a plurality of nozzles disposed proximate the end of the moldboard and is in communication with a fluid reservoir through a fluid pathway.

6. The system of claim 5, wherein the moldboard comprises a plurality of nozzles disposed proximate the end of the moldboard and is in communication with the fluid reservoir through the fluid pathway and a blower mechanism proximate the end of the moldboard and is in communication with a compressor through a gas pathway.

7. The system of claim 1, wherein the moldboard comprises the blower mechanism disposed proximate the end of the moldboard and is in communication with a compressor through a gas pathway.

8. The system of claim 7, wherein a portion of a gas is exhaust produced by the vehicle.

9. The system of claim 1, wherein the section follows a radius of curvature of the degradation drum.

10. The system of claim 1, wherein the end forms an 80-100 degree angle.

11. The system of claim 1, wherein an angled portion of the section is angled and a curved portion is curved into the milling chamber.

12. The system of claim 1, wherein the section is less than 0.25 inches above the bottom of the depth of cut.

13. The system of claim 1, wherein the end is within one foot of the milling drum.

14. The system of claim 1, wherein the moldboard comprises a plurality of nozzles disposed proximate a top of the moldboard and is in communication with the fluid reservoir through the fluid pathway.

15. The system of claim 1, wherein the section elevates following the contour of the degradation drum.

16. The system of claim 1, wherein a gas pathway retracts along with the section.

17. The system of claim 1, wherein a fluid pathway retracts along with the section.

18. The system of claim 1, wherein the section retracts from the paved surface.

19. The system of claim 1, wherein the section is designed to push loose aggregate.

20. The system of claim 1, wherein the section intentionally approaches the degradation drum.

* * * * *